US005630295A

United States Patent [19]

Neiman

[11] Patent Number: 5,630,295

[45] Date of Patent: May 20, 1997

[54] INTERFACE MECHANISM FOR INTERFACING A LOUVER TO A STILE OF A SHUTTER SYSTEM

[75] Inventor: David B. Neiman, Northridge, Calif.

[73] Assignee: Danmer, Inc., Chatsworth, Calif.

[21] Appl. No.: 591,740

[22] Filed: Jan. 25, 1996

[51] Int. Cl.[6] ..... E06B 7/08

[52] U.S. Cl. ..... 49/403

[58] Field of Search ..... 49/403, 74.1, 92.1; 160/236

[56] References Cited

U.S. PATENT DOCUMENTS 2,697,858 12/1954 Brenner ..... 49/403

3,750,336 8/1973 Johnson ..... 49/403 X 4,140,040 2/1979 Modrey ..... 85/74

4,744,290 5/1988 Josephson ..... 49/403 X

*Primary Examiner*—Kenneth J. Dorner

*Assistant Examiner*—Jerry Redman

*Attorney, Agent, or Firm*—Thomas I. Rozsa; Tony D. Chen

[57] ABSTRACT

An interface mechanism is used for shutter systems, which includes a hollow nylon bushing and a pin. The pin is positioned within the hollow bushing by inserting the pin therethrough and into the louver. The nylon bushing is press fitted into the stile and is held immobile by ears or flanges. Rotation of the louver causes the pin to turn within the bushing providing a uniform tactile feel and long life, as a result of a section of tiny grippers located adjacent to the head of the pin.

9 Claims, 3 Drawing Sheets

INTERFACE MECHANISM FOR INTERFACING A LOUVER TO A STILE OF A SHUTTER SYSTEM

BACKGROUND OF THE INVENTION

1. Field of the Invention

The present invention relates to the field of shutters. More particularly, the present invention relates to an interface mechanism for interfacing a louver to a stile of a shutter system.

2. Description of the Prior Art

In the manufacturing of shutter systems, a standard component used in the industry for interfacing a louver 12 to a stile 14 is shown in FIG. 8.

Referring to FIGS. 3, 4 and 8, there is shown at 10 a one piece nylon part which is used for interfacing the louver 12 to the stile 14 of the shutter system. The one piece nylon part 10 comprises a cylindrical distal portion 11 with a distal end 13, a proximal portion 15 with a proximal sharp tip end 16, and a circular washer 17 integrally connected between the distal portion 11 and the proximal portion 15. The sharp tip end 16 of the nylon part 10 is driven into the louver 12, where the proximal portion 15 is embedded therein. The distal portion 11 is installed within an aperture 18 drilled in the stile 14 such that the distal portion 11 rides rotatably within the aperture 18, where the circular washer 17 is located between the louver 12 and stile 14, thereby providing space for the louver to rotate in the traditional manner.

The disadvantage with the standard nylon part 10 is that the distal portion 11 rotates within the aperture 18 of the stile 14 as the louver 12 is rotated vertically. Eventually the interface between the distal portion 11 of the nylon part 10 and the aperture 18 of the louver 12 becomes "polished" (the aperture gets larger), and thereby the louver 12 has a tendency to droop after a period of time after it has been in use. It is therefore desirable to have a new interface mechanism, with which the manufacturer can avoid this significant disadvantage.

SUMMARY OF THE INVENTION

The present invention is a novel and unique interface mechanism for shutter systems. The interface mechanism is a two part device which is comprised of a metal pin and a hollow nylon bushing. The pin is positioned within the hollow bushing by inserting the pin therethrough. The pin is then driven into the louver. The nylon bushing is press fitted into an aperture located, on the stile and held immobile by ears or flanges. Rotation of the louver causes the pin to rotate within the bushing (i.e. the bushing does not rotate), thereby providing a uniform tactile feel and long life, as a result of knurled surface located adjacent to the head of the pin. The bushing/pin combination is equally effective in plastic or wood shutter systems.

It is therefore an object of the present invention to provide an interface mechanism which is comprised of a hollow nylon bushing and an elongated pin such that the interface mechanism can easily be operated to achieve high accuracy in holding and maintaining a louver to a specific position, thereby eliminating the problem of the louver drooping after a period of use.

It is an additional object of the present invention to provide a hollow nylon bushing which is comprised of flanges or ears so that when the bushing is press fitted within an aperture in the stile, the flanges will prevent the bushing from rotating within the aperture of the stile.

It is a further object of the present invention to provide an elongated pin which has a knurled surface or a section of grippers located adjacent to the head of the pin so that the knurled surface provides resistance to prevent the louver from drooping.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
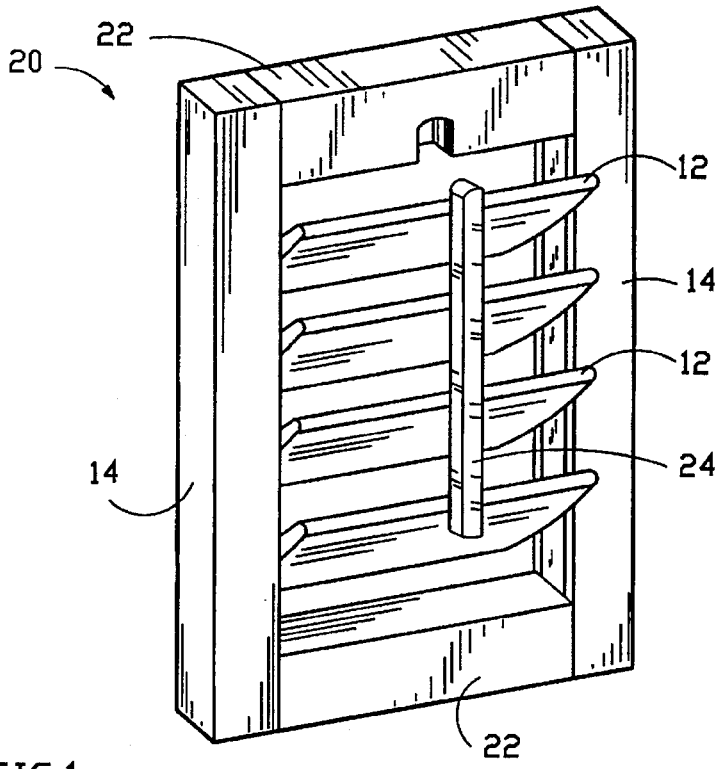
FIG. 1 is a perspective view of a custom shutter system.

Described briefly, the present invention deals with shutter systems. Referring to FIG. 1, there is shown a typical shutter system 20 which comprises a pair of opposite horizontal rails 22, a pair of opposite vertical stiles 14, a multiplicity of louvers 12 installed between the pair of opposite vertical stiles 14, and a tilt rod 24 which is stapled to the multiplicity of louvers 12 for opening and closing the louvers 12.

Figure 5:
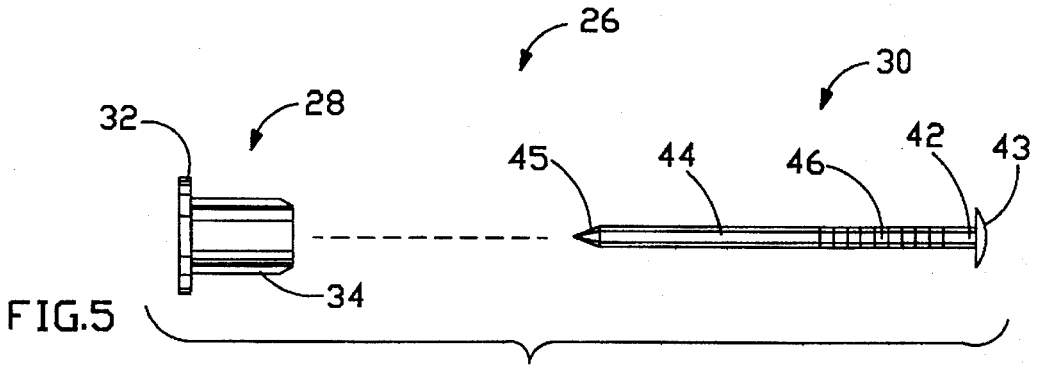
FIG. 5 is an exploded side elevational view of the interface mechanism of the present invention.

Referring to FIG. 5, there is shown at 26 an exploded view of the present invention interface mechanism which is comprised of an elongated pin 30 and a hollow nylon bushing 28.

The pin 30 comprises a distal portion 42 with a distal head end 43, a proximal portion 44 with a proximal sharp tip end 45, and a section of tiny grippers or knurled surface 46 located on the distal portion 42 and adjacent to the distal head end 43.

Figure 6:
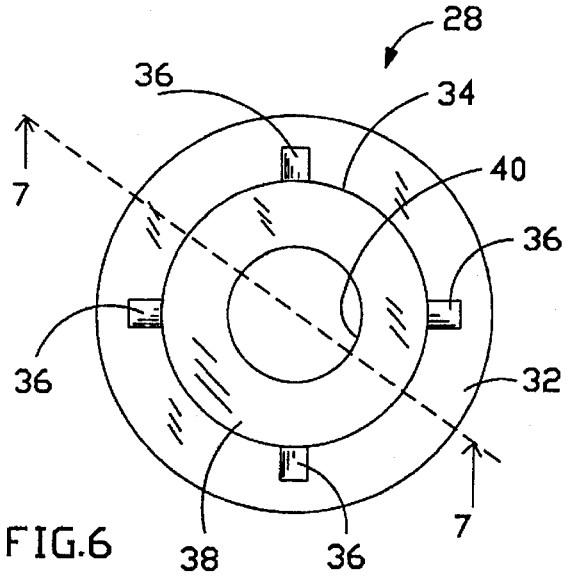
FIG. 6 is an enlarged top plan view of the hollow nylon bushing of the present invention interface mechanism.
Figure 7:
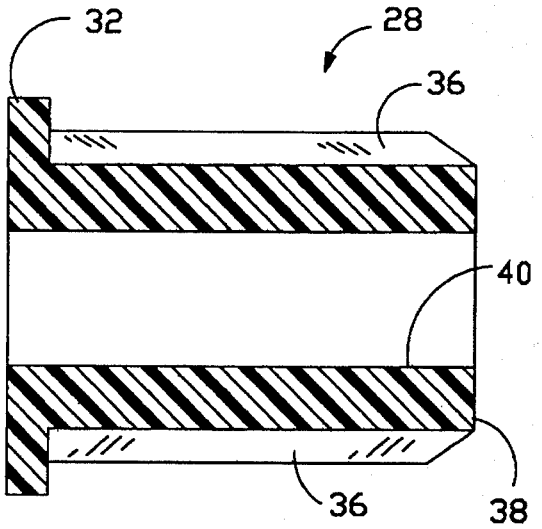
FIG. 7 is an enlarged cross-sectional view taken along line 7—7 of FIG. 6.
Figure 8:
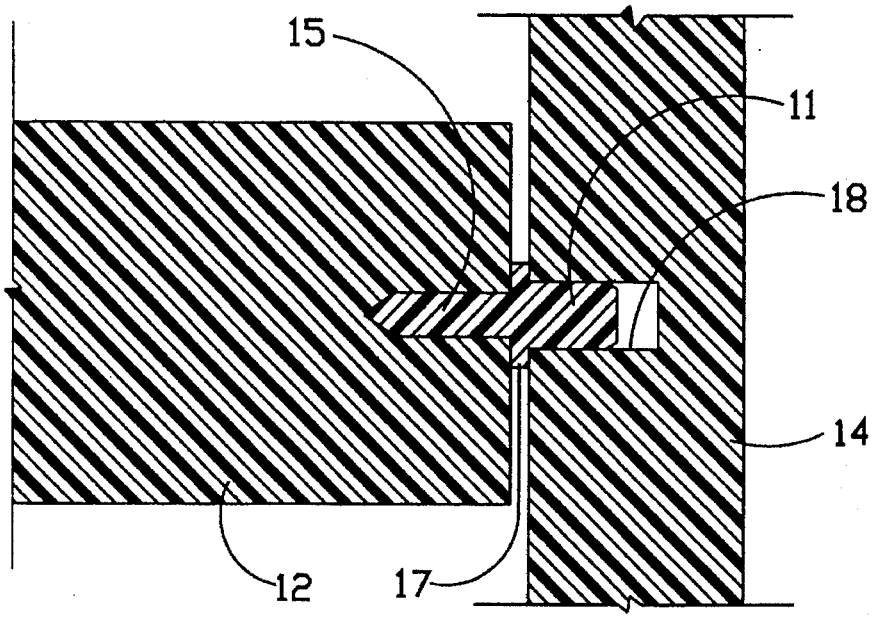
FIG.8(Prior Art)
FIG. 8 is a cross-sectional view of the louver installed to the stile utilizing a prior art one piece nylon fastener.

Referring to FIGS. 6 and 7, there is shown at 28 the bushing of the present invention, which comprises a circular base 32, a circumferential sidewall 34 and a multiplicity of equally spaced apart flanges or ears 36 located on the exterior surface of the circumferential sidewall 34. The circumferential sidewall 34 is integrally formed with and upwardly extending from the circular base 32 to form an upper rim 38. An opening 40 extends from the circular base 32 to the upper rim 38.

Figure 2:
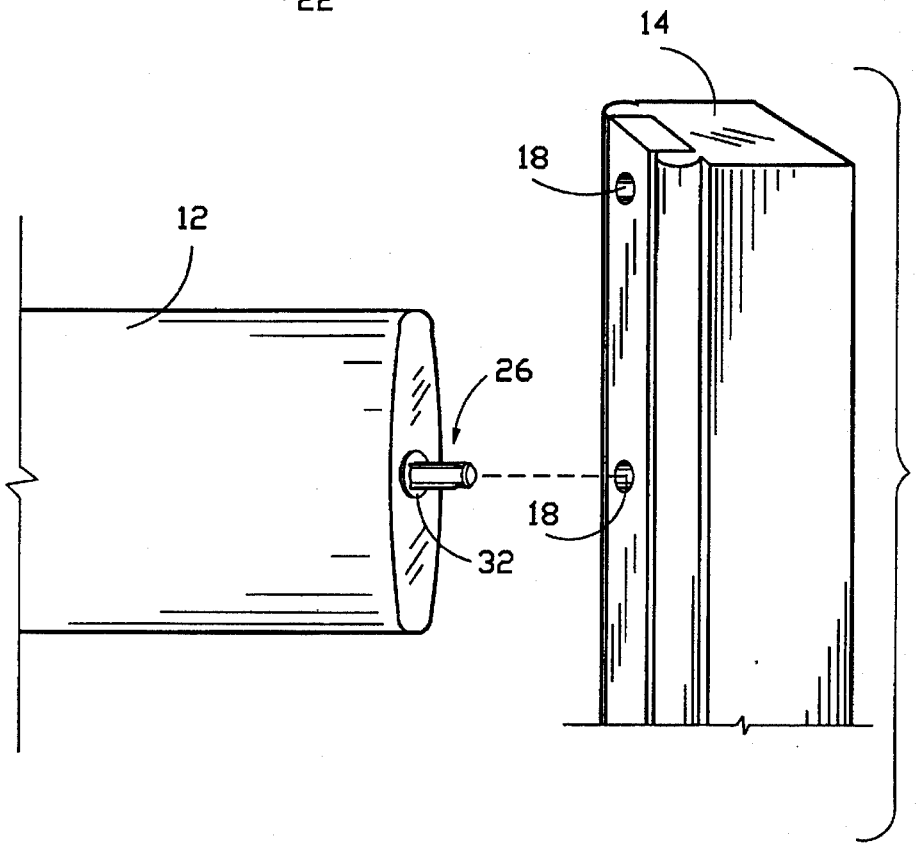
FIG. 2 is a partial exploded perspective view of the louver being installed into the stile utilizing the present invention interface mechanism.
Figure 3:
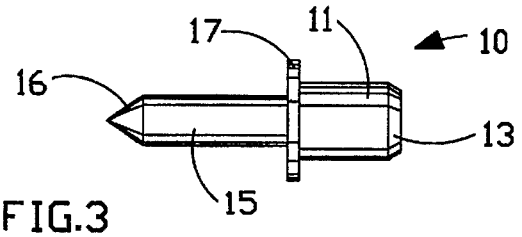
FIG.3 (Prior Art)
FIG. 3 is a side elevational view of a prior art one piece nylon fastener.
Figure 4:
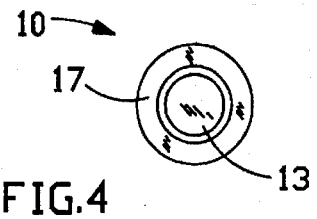
FIG.4 (Prior Art)
FIG. 4 is a top plan view of the prior art one piece nylon fastener shown in FIG. 3.
Figure 9:
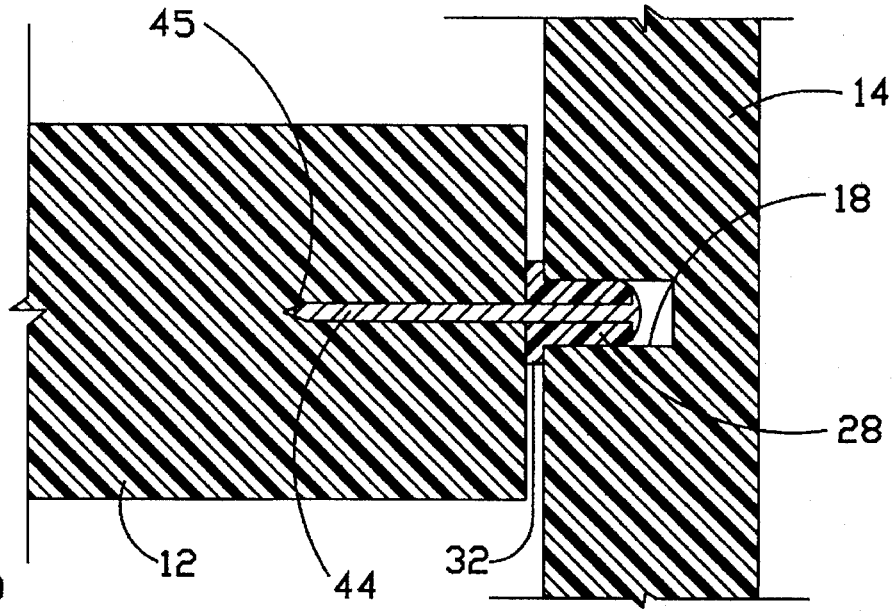
FIG. 9 is a cross-sectional view of the louver installed to the stile utilizing the present invention interface mechanism.

Referring to FIGS. 2 and 9, there is shown the interface mechanism 26 of the present invention, which is utilized by the typical shutter system. The pin 30 is inserted through the opening 40 of the bushing 28, where the circumferential sidewall 34 covers the distal portion 42 of the pin 30. The pin 30 is installed by driving the proximal sharp tip end 45 into the louver 12 with a hammer or other suitable tool such that the proximal portion 44 is embedded within the louver. The circumferential sidewall 34 of the bushing 28 is then installed by being press fitted within an aperture 18 in the stile 14 such that the flanges 36 grip the interior of the aperture 18 and immobilize the bushing 28 from rotating within the aperture 18 when the louver 12 is rotated. The distal portion 42 of the pin 30 rides rotatably within the opening 40 of the bushing 28, where the knurled surface 46 provides resistance and prevents the louver 12 from drooping. Rotation of the louver 12 causes the pin 30 to rotate within the opening 40 of the bushing 28, thereby providing a uniform tactile feel and long life interface between the louver 12 and the stile 14. The circular base 32 of the bushing 28 is located between the louver 12 and the stile 14, thereby providing space for the louver 12 to rotate in a vertical direction.

Both the bushing 28 and the pin 30 are manufactured with a 0.0005 inch tolerance. The diameter of the pin 30 is approximately 0.082±0.0005 inch to ensure high tolerance. The pin 30 is made of hardened steel or other suitable material that is drawn through a die to assure maintenance of 0.0005 inch diameter tolerance. This tolerance is maintained through the forming process. By way of example, the pin 30 may be C-1022 material. The inside diameter of the opening 40 of the bushing 28 is approximately 0.0825±0.0005 inch to ensure high tolerance. The bushing 28 is made of nylon material or other suitable material and is molded such that the tolerance within the opening 40 that interfaces with the pin 30 remains 0.0005 inch after the bushing 28 is cooled and released from the mold. By way of example, the bushing 28 may be Nylon #6 material. The bushing/pin combination is equally effective in plastic or wood shutter systems.

The manufacturing process which could accommodate the construction of the nylon bushing may be injection, thermoform, other molding process, etc. or any other conventional way known to one skilled in the art.

The present invention interface mechanism 26 will prevent the louver 12 from drooping after time.

Defined in detail, the present invention is an interface mechanism used in conjunction with a shutter system having at least one louver and at least one stile with an aperture, the interface mechanism comprising: (a) a hollow bushing having a circular base, a circumferential sidewall and a multiplicity of equally spaced apart flanges located on the circumferential sidewall, the circumferential sidewall integrally formed with and upwardly extending from the circular base; (b) an elongated pin having a distal portion with a distal head end, a proximal portion with a proximal sharp tip end, and a section of grippers located on the distal portion and adjacent to the distal head end, where the distal portion is positioned inside the hollow bushing and covered by the circumferential sidewall; and (c) the proximal sharp tip end of the pin driven into the at least one louver such that the proximal portion is embedded therein, the circumferential sidewall of the hollow bushing being press fitted within the aperture in the stile such that the multiplicity of flanges of the hollow bushing prevent the bushing from rotating within the aperture so that the distal portion of the pin rides rotatably inside the bushing, where the circular base of the hollow bushing is located between the at least one louver and the at least one stile, thereby providing space for the at least one louver to rotate in a vertical direction and the section of grippers of the pin deter the at least one louver from drooping.

Defined broadly, the present invention is an interface mechanism used in conjunction with a shutter system having at least one louver and at least one stile with an aperture, the interface mechanism comprising: (a) a bushing having a base, a sidewall and at least one flange located on the sidewall, the sidewall integrally formed with and upwardly extending from the base; (b) a pin having a distal portion with a distal end, a proximal portion with a proximal end, and a knurled surface located on the distal portion and adjacent to the distal end, where the distal portion is positioned inside the bushing and covered by the sidewall; and (c) the proximal end of the pin driven into the at least one louver such that the proximal portion is embedded therein, the sidewall of the bushing being press fitted within the aperture in the at least one stile such that the at least one flange of the bushing prevents the bushing from rotating within the aperture so that the distal portion of the pin rides rotatably inside the bushing, where the base of the bushing is located between the at least one louver and the at least one stile, thereby providing space for the at least one louver to rotate in a vertical direction and the knurled surface of the pin deters the at least one louver from drooping.

Defined more broadly, the present invention is a device used in conjunction with a shutter system having at least one louver and at least one stile with an aperture, the device comprising: (a) a bushing having at least one flange; and (b) a pin having a distal portion, a proximal portion, and a knurled surface, the distal portion positioned inside the bushing such that the proximal portion is driven into the at least one louver and embedded therein, the bushing being press fitted within the aperture in the stile such that the at least one flange of the bushing prevents it from rotating within the aperture so that the distal portion rides rotatably within the bushing, thereby allowing the at least one louver to rotate and the knurled surface deters the at least one louver from drooping.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A mechanism used in conjunction with a shutter system having at least one louver and at least one stile with an aperture, the mechanism comprising:

a. a hollow bushing having a circular base, a circumferential sidewall and a multiplicity of equally spaced apart flanges located on the circumferential sidewall, the circumferential sidewall integrally formed with and upwardly extending from the circular base;

b. an elongated pin having a distal portion with a distal head end, a proximal portion with a proximal sharp tip end, and a section of grippers located on the distal portion and adjacent to the distal head end, where the distal portion is positioned inside said hollow bushing and covered by said circumferential sidewall; and c. said proximal sharp tip end of said pin driven into said at least one louver such that said proximal portion is embedded therein, said circumferential sidewall of said hollow bushing being press fitted within said aperture in said stile such that said multiplicity of flanges of said hollow bushing prevent said bushing from rotating within said aperture so that said distal portion of said pin rides rotatably inside said bushing, where said circular base of said hollow bushing is located between said at least one louver and said at least one stile, thereby providing space for said at least one louver to rotate in a vertical direction and said section of grippers of said pin deter said at least one louver from drooping.

2. The mechanism in accordance with claim 1 wherein said hollow bushing is made of nylon material.

3. The mechanism in accordance with claim 2 wherein said nylon material is generally Nylon #6 material.

4. The mechanism in accordance with claim 1 wherein said pin is made of hardened steel.

5. The mechanism in accordance with claim 4 wherein said hardened steel is C-1022.

6. A mechanism used in conjunction with a shutter system having at least one louver and at least one stile with an aperture, the mechanism comprising:

a. a bushing having a base, a sidewall and at least one flange located on the sidewall, the sidewall integrally formed with and upwardly extending from the base;

b. a pin having a distal portion with a distal end, a proximal portion with a proximal end, and a knurled surface located on the distal portion and adjacent to the distal end, where the distal portion is positioned inside said bushing and covered by said sidewall; and c. said proximal end of said pin driven into said at least one louver such that said proximal portion is embedded therein, said sidewall of said bushing being press fitted within said aperture in said at least one stile such that said at least one flange of said bushing prevents said bushing from rotating within said aperture so that said distal portion of said pin rides rotatably inside said bushing, where said base of said bushing is located between said at least one louver and said at least one stile, thereby providing space for said at least one louver to rotate in a vertical direction and said knurled surface of said pin deters said at least one louver from drooping.

7. The mechanism in accordance with claim 6 wherein said bushing is made of plastic material.

8. The mechanism in accordance with claim 6 wherein said pin is made of metal material.

9. The mechanism in accordance with claim 6 wherein said knurled surface of said pin is generally a section of tiny grippers.

* * * * *